US009780460B2

(12) United States Patent
Koto

(10) Patent No.: US 9,780,460 B2
(45) Date of Patent: Oct. 3, 2017

(54) ELECTRIC CABLE CONNECTION TERMINAL AND WIRE HARNESS HAVING THE ELECTRIC CABLE CONNECTION TERMINAL

(75) Inventor: Naoki Koto, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 13/525,425

(22) Filed: Jun. 18, 2012

(65) Prior Publication Data

US 2012/0318575 A1 Dec. 20, 2012

(30) Foreign Application Priority Data

Jun. 17, 2011 (JP) ..... 2011-134906

(51) Int. Cl.
*H01R 4/72* (2006.01)
*H01R 4/18* (2006.01)

(52) U.S. Cl.
CPC ..... *H01R 4/185* (2013.01); *H01R 4/72* (2013.01)

(58) Field of Classification Search
CPC ..... H01R 4/72; H01R 4/185
USPC ..... 174/77 R, 88 R, 93, DIG. 8
See application file for complete search history.

(56) References Cited

U.S. PATENT DOCUMENTS

| | | | | |
|---|---|---|---|---|
| 3,243,211 | A * | 3/1966 | Wetmore | 403/28 |
| 3,417,195 | A * | 12/1968 | Shlesinger, Jr. | 174/84 C |
| 4,067,105 | A * | 1/1978 | Zahn et al. | 29/869 |
| 5,393,932 | A * | 2/1995 | Young | H01Q 1/244 174/84 R |
| 5,440,074 | A * | 8/1995 | Meltsch et al. | 174/88 R |

FOREIGN PATENT DOCUMENTS

| | | | |
|---|---|---|---|
| CN | 2728066 | Y | 9/2005 |
| CN | 201364963 | Y | 12/2009 |
| GB | 1391158 | A | 4/1975 |
| JP | S53161290 | U | 12/1978 |
| JP | 200243010 | A | 2/2002 |
| JP | 2009009736 | A | 1/2009 |

OTHER PUBLICATIONS

Communication dated Mar. 24, 2014 from the State Intellectual Property Office of P.R. China in a counterpart application No. 201210206473.8.

(Continued)

*Primary Examiner* — Jenny L Wagner
*Assistant Examiner* — Michael E Moats, Jr.
(74) *Attorney, Agent, or Firm* — Sughrue Mion, PLLC

(57) ABSTRACT

There is provided an electric cable connection terminal. A first connection part is configured to connect the one electric cable thereto. A second connection part is configured to connect the other electric cable thereto. A waterproof member is configured to be melted to seal leading end portions of core wires of the electrics cable when being heated and configured to be solidified to waterproof the leading end portions when being cooled. An accommodation part accommodating the waterproof member therein is provided between the first and second connection parts. A thermal shrinkage member is provided to cover the first and second connection parts and the accommodation part and configured to be shrunken when being heated to closely contact the first and second connection parts and the accommodation part. When the cables are connected to the first and second connection part, respectively, the core wires are arranged at an interval.

8 Claims, 4 Drawing Sheets

(56) References Cited

OTHER PUBLICATIONS

Office Action dated Oct. 23, 2014, issued by the State Intellectual Property Office of the People's Republic of China in counterpart Chinese Application No. 201210206473.8.
Office Action dated Mar. 9, 2015, issued by the State Intellectual Property Office of P.R. China in counterpart Chinese Application No. 201210206473.8.
Communication dated Feb. 24, 2015, issued by the Japanese Intellectual Property Office in counterpart Japanese Application No. 2011-134906.

* cited by examiner

ELECTRIC CABLE CONNECTION TERMINAL AND WIRE HARNESS HAVING THE ELECTRIC CABLE CONNECTION TERMINAL

The disclosure of Japanese Patent Application No. 2011-134906 filed on Jun. 17, 2011, including specification, drawings and claims is incorporated herein by reference in its entirety.

BACKGROUND

The invention relates to an electric cable connection terminal where a core wire made of aluminum or aluminum alloy and a core wire consisting of copper or copper alloy are connected in a non-contact manner, introduced water is subject to waterproofing and thus corrosions of the core wire made of aluminum or aluminum alloy and the core wire consisting of copper or copper alloy are prevented, and a wire harness having the electric cable connection terminal.

In an automobile and the like, a variety of electronic devices are mounted. Hence, in the automobile and the like, a wire harness is arranged so as to deliver desired power or signal to the electronic devices. The wire harness has an electric cable having a terminal fitting for connection to the electronic device compression-connected to a terminal thereof. For the terminal fitting, copper or copper alloy that has the performance and reliability over a long time period and has been thus stably used is generally used.

In recent years, in order to save the energy or to reduce the exhaust gas, the electric cable of the wire harness that is arranged in the automobile and the like has been changed from an electric cable having a conductor made of copper or copper alloy to an electric cable having a conductor made of aluminum or aluminum alloy.

However, the aluminum or aluminum alloy forms a robust oxide film on a surface thereof. Thus, when a terminal fitting made of copper or copper alloy is compression-connected to a terminal of an electric cable having a conductor made of aluminum or aluminum alloy, contact resistances of the conductor and the terminal are increased with time. Therefore, it is difficult to perform the compression connection having the high reliability with the same manner as that for the electric cable having a conductor made of copper or copper alloy.

Also, the connection reliability of the terminal fitting made of copper or copper alloy is secured by an extensive performance evaluation including a durability test at a development stage or by an actual longtime using performance in a vehicle. Therefore, when the terminal fitting is made of aluminum or aluminum alloy, the compression conditions should be optimized, the connection reliability should be confirmed and the terminal should be developed, so that much cost and time are required.

Accordingly, a terminal connection structure has been suggested in which an electric cable having a conductor made of aluminum or aluminum alloy is connected with an electric cable having a terminal fitting made of copper or copper alloy and provided at a terminal and having a conductor made of copper or copper alloy (for example, refer to Patent Document 1). According to the terminal connection structure of Patent Document 1 (JP-A-2009-9736), an electric cable having a core wire made of aluminum or aluminum alloy is connected with an electric cable having a terminal fitting made of copper or copper alloy and provided at a terminal and having a core wire made of copper or copper alloy, and an insulator tube is provided to the connection part.

Patent Document 1: JP-A-2009-009736

However, according to the terminal connection structure disclosed in Patent Document 1, the core wire made of aluminum or aluminum alloy is directly connected with the core wire made of copper or copper alloy and the connection part having connected the core wire made of aluminum or aluminum alloy and the core wire made of copper or copper alloy is simply covered with the insulator tube. Therefore, when water is introduced into the connection part by a capillary phenomenon, the connection part in which the different metals are connected and contacted to each other forms a local cell, so that contact corrosion of different metals, in which the aluminum is eluted as a cation, is caused. As a result, the contact resistance of the connection part is increased.

SUMMARY

It is thereof an object of the present invention is to provide an electric cable connection terminal where a core wire made of aluminum or aluminum alloy and a core wire consisting of copper or copper alloy are connected in a non-contact manner, introduced water is subject to waterproofing and thus corrosions of the core wire made of aluminum or aluminum alloy and the core wire consisting of copper or copper alloy are prevented, and a wire harness having the electric cable connection terminal.

According to a first aspect of the embodiments of the present invention, there is provided an electric cable connection terminal configured to connect one electric cable and the other electric cable, the electric cable connection terminal comprising: a first electric cable connection part provided at one end side of the electric cable connection terminal and configured to connect the one electric cable thereto; a second electric cable connection part provided at the other end side of the electric cable connection terminal and configured to connect the other electric cable thereto; a waterproof member configured to be melted to seal a leading end portion of a core wire of the one electric cable and a leading end portion of a core wire of the other electric cable when being heated and configured to be solidified to waterproof the leading end portion of the core wire of the one electric cable and the leading end portion of the core wire of the other electric cable when being cooled; an accommodation part provided between the first electric cable connection part and the second electric cable connection part and configured to accommodate the waterproof member therein; and a thermal shrinkage member provided to cover the first electric cable connection part, the second electric cable connection part and the accommodation part and configured to be shrunken when being heated to closely contact the first electric cable connection part, the second electric cable connection part and the accommodation part, wherein when the one electric cable is connected to the first electric cable connection part and the other electric cable is connected to the second electric cable connection part, the core wire of the one electric cable and the core wire of the other electric cable are arranged at an interval.

In the above configuration, the core wire of the one electric cable connected to the first electric cable connection part and the core wire of the other electric cable connected to the second electric cable connection part are arranged at an interval, the leading end portion of the core wire of the one electric cable and the leading end portion of the core wire of the other electric cable are sealed and waterproofed by the waterproof member and the thermal shrinkage member is in close contact with the accommodation part accommodating therein the waterproof member, the first electric cable connection part and the second electric cable connection part. Therefore, even when the water is introduced from the one electric cable and the other electric cable by the capillary phenomenon, the electric cable connection terminal can prevent the water from being introduced to the leading end portion of the core wire of the one electric cable and the leading end portion of the core wire of the other electric cable. As a result, it is possible to prevent the corrosions of the leading end portion of the core wire of the one electric cable and the leading end portion of the core wire of the other electric cable.

Also, a universal terminal fitting can be used for connection with an electronic device and the like. Hence, it is possible to prevent the cost from being increased due to the development, the evaluation test and the like of a new terminal fitting.

The core wire of the one electric cable may be made of aluminum or aluminum alloy, and the core wire of the other electric cable may be made of copper or copper alloy.

In the above configuration, the core wire of the one electric cable is made of aluminum or aluminum alloy and the core wire of the other electric cable is made of copper or copper alloy. Therefore, since the leading end portion of the core wire made of aluminum or aluminum alloy and the leading end portion of the core wire made of copper or copper alloy are arranged at an interval, the electric cable connection terminal can prevent the contact corrosion of the different metals, which is caused as both the core wires are contacted to each other, and thus can prevent the respective contact resistances of both the core wires from being increased.

The thermal shrinkage member may have permeability, and the waterproof member may be colored.

In the above configuration, the thermal shrinkage member has permeability and the waterproof member is colored. Thus, when the thermal shrinkage member is heated and thus closely contacted to the first electric cable connection part, the second electric cable connection part and the accommodation part, it is possible to check a state where the waterproof member accommodated in the accommodation part is being melted and spread to the leading end portion of the core wire of the one electric cable and the leading end portion of the core wire of the other electric cable with naked eyes. Hence, it is possible to securely seal and waterproof the leading end portions of both the core wires with the waterproof member by checking the state where the waterproof member is sufficiently melted and spread to both the leading end portions with naked eyes.

The waterproof member may be made of a thermoplastic adhesive or grease.

In the above configuration, the waterproof member is made of a thermoplastic adhesive or grease. Thus, the handling and the operation thereof are easy and the cost thereof is also cheap. Also, since the thermoplastic adhesive is rapidly cured, the processing time is shortened and thus the productivity becomes favorable.

According to a second aspect of the embodiments of the present invention, there is provided a wire harness having one electric cable and the other electric cable which are connected via the above-described electric cable connection terminal.

In the above configuration, one electric cable and the other electric cable are connected via the electric cable connection terminal according to one of claims 1 to 4. Hence, it is possible to prevent the corrosions of the leading end portion of the core wire of the one electric cable and the leading end portion of the core wire of the other electric cable, to prevent the contact corrosion of the different metals, which is caused as both the core wires are contacted to each other, and to thus prevent the respective contact resistances of both the core wires from being increased and to securely seal and waterproof the leading end portions of both the core wires with the waterproof member. Also, the wire harness is cheap and the productivity thereof becomes favorable.

BRIEF DESCRIPTION OF THE DRAWINGS

In the accompanying drawings:

FIGS. 4A to 4C are perspective views illustrating a configuration of a wire harness having an electric cable connection terminal according to an illustrative embodiment of the invention, in which FIG. 4A is a perspective view showing a terminal main body part, FIG. 4B is a perspective view showing a thermal shrinkage tube and FIG. 4C is a perspective view showing a thermoplastic adhesive;

DETAILED DESCRIPTION OF THE EMBODIMENTS

Hereinafter, an illustrative embodiment of the invention will be described with reference to FIGS. 1 to 7.

Figure 1:
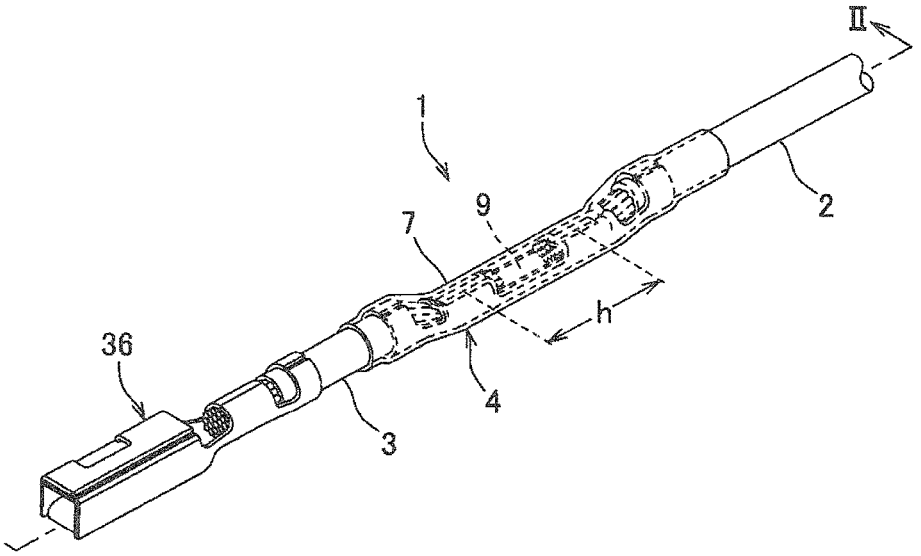
FIG. 1 is a perspective view illustrating a configuration of a wire harness having an electric cable connection terminal according to an illustrative embodiment of the invention.

As shown in FIG. 1, a wire harness 1 having an electric cable connection terminal 4 according to an illustrative embodiment of the invention has an aluminum electric cable 2 that is one electric cable, a copper electric cable 3 that is the other electric cable, and an electric cable connection terminal 4 that electrically connects the aluminum electric cable 2 and the copper electric cable 3.

Figure 3:
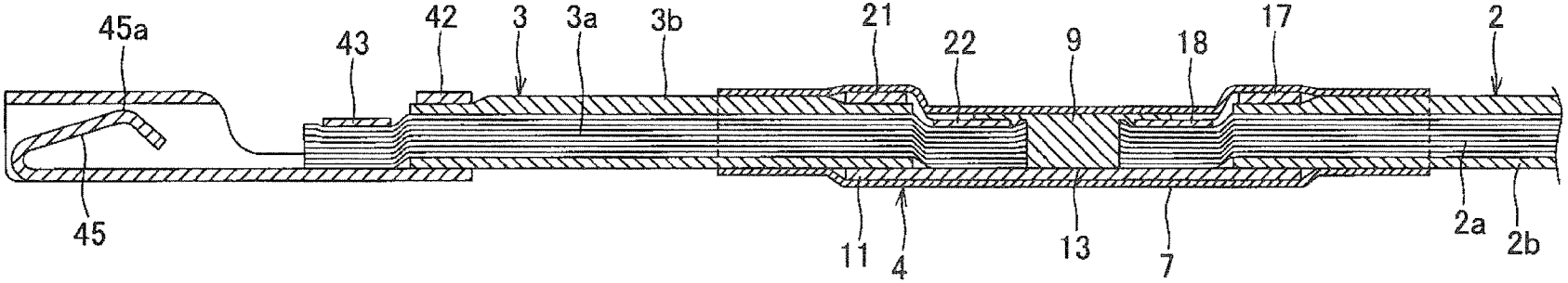
FIG. 3 is a sectional view taken along a line II-II of the wire harness shown in FIG. 1.

As shown in FIG. 3, the aluminum electric cable 2 has a conductive core wire 2*a* and an insulating cover part 2*b*. The core wire 2*a* is formed by a plurality of conductive wires twisted. The wire is made of aluminum or aluminum alloy. The cover part 2*b* is made of synthetic resin such as polyvinyl chloride resin. The cover part 2*b* covers the core wire 2*a*. In the meantime, the core wire 2*a* may consist of a single wire.

The aluminum electric cable 2 is arranged and long formed in a vehicle (not shown) such as automobile. The description "long formed" means that the aluminum electric cable has such a length that it is arranged in a three-dimensional structure in a vehicle such as automobile and can be connected to an electronic device or power supply device mounted on the vehicle. In the meantime, the aluminum electric cable 2 is not particularly limited to a sectional area of the core wire 2*a*, insulator material and thickness of the cover part 2*b*, a length of the electric cable, a diameter of the electric cable and the like.

As shown in FIG. 3, the copper electric cable 3 has a conductive core wire 3*a* and an insulating cover part 3*b*. The core wire 3*a* is formed by a plurality of conductive wires twisted. The wire is made of copper or copper alloy. The cover part 3*b* is made of synthetic resin such as polyvinyl chloride resin. The cover part 3*b* covers the core wire 3*a*. In the meantime, the core wire 3*a* may consist of a single wire.

Figure 2:
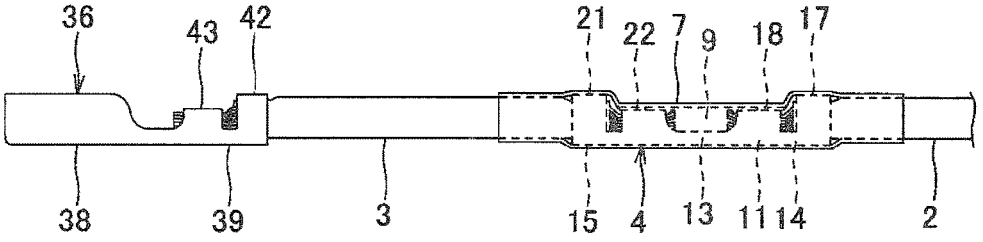
FIG. 2 shows a side of the wire harness shown in FIG. 1.

As shown in FIGS. 1 to 3, the cover part 3*b* of the copper electric cable 3 is stripped at terminals of both ends thereof. One terminal is connected to a terminal fitting 36 and the other terminal is connected to the electric cable connection terminal 4. The copper electric cable 3 has a short length capable of connecting an electric device (not shown) and the aluminum electric cable 2 each other. The description "the copper electric cable 3 has a short length" means that the copper electric cable has such a length that it can be connected to the terminal fitting 36 and the electric cable connection terminal 4, respectively.

In the meantime, the copper electric cable 3 is not particularly limited to a sectional area of the core wire 3*a*, insulator material and thickness of the cover part 3*b*, a length of the electric cable, a diameter of the electric cable and the like. That is, a copper electric cable that is generally used can be used. Also, the length of the copper electric cable 3 can be varied for each length of the wire harness 1 so that the connection part with the terminal fitting 36 does not have an effect on flexure and branching of the wire harness 1. Also, even when the copper electric cable 3 exists at the same place, it does not deteriorate a function of the wire harness 1 because it is not thickened.

The terminal fitting 36 is a so-called female terminal having a cornered cylinder shape and has an electric contact part 38 that is connected to a terminal of the other party and an electric cable connection part 39 to which the copper electric cable 3 is connected. The terminal fitting 36 is formed by punching a metal sheet made of copper or copper alloy into a developed shape of the terminal fitting 36 and then bending the same. In the meantime, the terminal fitting 36 is not limited to the female terminal as shown. That is, a male terminal may be also used and a terminal fitting that is generally used may be used. Thereby, since the terminal fitting 36 and the copper electric cable 3, which are made of copper or copper alloy having the connection reliability secured by the extensive performance evaluation or using performance, it is possible to make the connection having the high reliability based on the performance accumulated up to now. Also, when using the terminal fitting, it is not necessary to additionally perform the extensive performance evaluation or test, so that it is possible to suppress the developing cost.

As shown in FIG. 3, the electric contact part 39 has a pressing member 45 for pressing the terminal of the other party and positively securing the electric contact. The electric contact part 38 is provided at a leading end portion of the terminal fitting 36 and extends from the leading end portion toward a central portion. A free end of the electric contact part 38 is formed with a bent portion 45*a* that is engaged into an engaging recess portion of the terminal of the other party and enables the terminal of the other party to be smoothly separated and inserted.

The electric cable connection part 39 has a pair of cover swaging pieces 42 that swages the cover part 3*b* of the copper electric cable 3 and a pair of core wire swaging pieces 43 that swages the core wire 3*a* of the copper electric cable 3. The electric cable connection part 39 has a cylindrical shape corresponding to an outward appearance of the copper electric cable 3.

The cover swaging pieces 42 stand and extend from both edges of an end portion of the terminal fitting 36. The cover swaging pieces 42 is also referred to as a rear foot part and robustly maintains the electric cable 3 against the flexure of the wire harness 1 and improves the strength of the terminal fitting 36 against the flexure. Also, the terminal fitting 36 having no cover swaging pieces 42 may also configure the wire harness 1 of the invention.

The core wire swaging pieces 43 are provided at a more central portion of the terminal fitting than the cover swaging pieces 42 and stand and extend from both edges. The core wire swaging pieces 43 less extend than the cover swaging pieces 42.

As shown in FIGS. 1 to 3, the electric cable connection terminal 4 has a terminal main body part 11 that connects the aluminum electric cable 2 and the copper electric cable 3 each other, a waterproof member 9 that is accommodated in the terminal main body part 11 waterproofs the aluminum electric cable 2 and the copper electric cable 3 and a thermal shrinkage tube 7 that has a cylindrical shape and serves as a thermal shrinkage member covering the terminal main body part 11 and the waterproof member 9.

The terminal main body part 11 has a first electric cable connection part 14 that is connected to a terminal of the aluminum electric cable 2, a second electric cable connection part 15 that is connected to the other terminal of the copper electric cable 3 and an accommodation part 13 in which the waterproof member 9, which protects the terminals of both electric cables 2, 3 against the water, is accommodated. The terminal main body part 11 is formed by punching a metal sheet made of copper or copper alloy into a developed shape of the terminal main body part 11 and then bending the same.

As shown in FIGS. 1, 3 and 4A to 4C, the first electric cable connection part 14 has a pair of first cover swaging pieces 17 that swages the cover part 2*b* of the aluminum electric cable 2 and a pair of first core wire swaging pieces 18 that swages the core wire 2*a* of the aluminum electric cable 2. The first electric cable connection part 14 is provided at one end of the terminal main body part 11.

The first cover swaging pieces 17 are provided at one end of the terminal main body part 11 and stand and extend from both edges in a direction orthogonal to a longitudinal direction of the terminal main body part 11. The first cover swaging pieces 17 form a cylindrical shape corresponding to the outward appearance of the cover part 2*b* when swaging the cover part 2*b* of the aluminum electric cable 2.

The first core wire swaging pieces 18 are provided at a more central portion of the terminal main body part 11 than the first cover swaging pieces 17 and stand and extend from both edges in the direction orthogonal to the longitudinal direction of the terminal main body part 11. The first core wire swaging pieces 18 less extend than the first cover swaging pieces 17. The first core wire swaging pieces 18 form a shape having an M section so that free ends of the first core wire swaging pieces 18 are bitten into the core wire 2*a* toward the center of the core wire 2*a* when swaging the core wire 2*a* of the aluminum electric cable 2.

The second electric cable connection part 15 has a pair of second cover swaging pieces 21 that swages the cover part 3*b* of the copper electric cable 3 and a pair of second core wire swaging pieces 22 that swages the core wire 3*a* of the copper electric cable 2. The second electric cable connection part 15 is provided at the other end of the terminal main body part 11.

The second cover swaging pieces 21 are provided at the other end of the terminal main body part 11 and stand and extend from both edges in the direction orthogonal to the longitudinal direction of the terminal main body part 11. The second cover swaging pieces 21 form a cylindrical shape corresponding to the outward appearance of the cover part 3*b* when swaging the cover part 3*b* of the copper electric cable 2.

The second core wire swaging pieces 22 are provided at a more central portion of the terminal main body part 11 than the second cover swaging pieces 21 and stand and extend from both edges in the direction orthogonal to the longitudinal direction of the terminal main body part 11. The second core wire swaging pieces 22 less extend than the second cover swaging pieces 21. The second core wire swaging pieces 22 form a shape having an M section so that free ends of the second core wire swaging pieces 22 are bitten into the core wire 3*a* toward the center of the core wire 3*a* when swaging the core wire 3*a* of the copper electric cable 3.

The accommodation part 13 is provided between the first electric cable connection part 14 and the second electric cable connection part 15 and at the central portion of the terminal main body part 11. The accommodation part 13 has a shape having a U section. The accommodation part 13 is formed so that the leading end portion of the core wire 2*a* of the aluminum electric cable 2 connected to the first electric cable connection part 14 and the leading end portion of the core wire 3*a* of the copper electric cable 3 connected to the second electric cable connection part 15 are respectively arranged at both ends of the terminal main body part 11 in the longitudinal direction.

The waterproof member 9 is formed to correspond to the shape of the accommodation part 13 of the terminal main body part 11 and has a triangular prism shape extending in the longitudinal direction of the terminal main body part 11. In the meantime, the waterproof member 9 is melted when it is heated. Hence, the waterproof member is not limited to the triangular prism shape as shown. For the waterproof member 9, a thermoplastic adhesive or grease may be used.

The thermoplastic adhesive is a so-called hot melt adhesive and may include an insulating solid having an ethylene vinyl acetate resin or polyolefin resin as a main component. In the meantime, regarding the thermoplastic adhesive, an adhesive having a softening point of about 100° C. at which it is softened is used. The thermoplastic adhesive is colored such as red by organic or inorganic-based pigment or dye so that it is prominent. In the meantime, the thermoplastic adhesive that is softened around a temperature at which the thermal shrinkage tube 7 (which will be described later) is shrunken is favorably used.

When the grease is used as the waterproof member 9, instead of the thermoplastic adhesive, petroleum-based grease or silicon-based grease may be used. The grease is colored such as red by organic or inorganic-based pigment or dye so that it is relatively prominent.

The thermal shrinkage tube 7 consists of polyolefin resin, polyvinyl chloride resin and the like and has a flexible cylindrical shape. The thermal shrinkage tube 7 is formed to have a length longer than the overall length of the terminal main body part 11 in the longitudinal direction. Also, the thermal shrinkage tube is long formed to cover an outer periphery of the cover part 2*b* of the aluminum electric cable 2 connected to the first electric cable connection part 14 of the terminal main body part 11 and an outer periphery of the cover part 3*b* of the copper electric cable 2 connected to the second electric cable connection part 15. An inner diameter of the thermal shrinkage tube 7 is formed to be larger than an outer diameter of the aluminum electric cable 2 or copper electric cable 3. Regarding the thermal shrinkage tube, a tube having a shrinkage temperature of about 100° C. at which it is shrunken is used.

In the meantime, the melting temperatures of the cover part 2*b* of the aluminum electric cable 2, the cover part 3*b* of the copper electric cable 3, the thermoplastic adhesive 9 and the thermal shrinkage tube 7 are decreased in order of the cover part 2*b*, the cover part 3*b*, the thermoplastic adhesive 9 and the thermal shrinkage tube 7. Thereby, it is possible to sufficiently melt the thermoplastic adhesive 9 and to shrink and closely contact the thermal shrinkage tube 7 by heating without deteriorating the insulation and performance of both the electric cables 2, 3.

In the below, a method of manufacturing the wire harness 1 configured as described above is described with reference to the drawings.

Figure 4A:
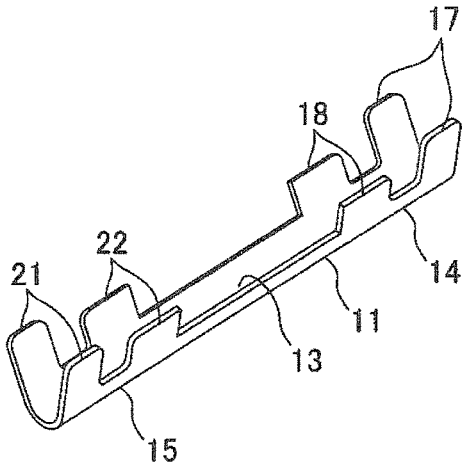
Figure 4B:
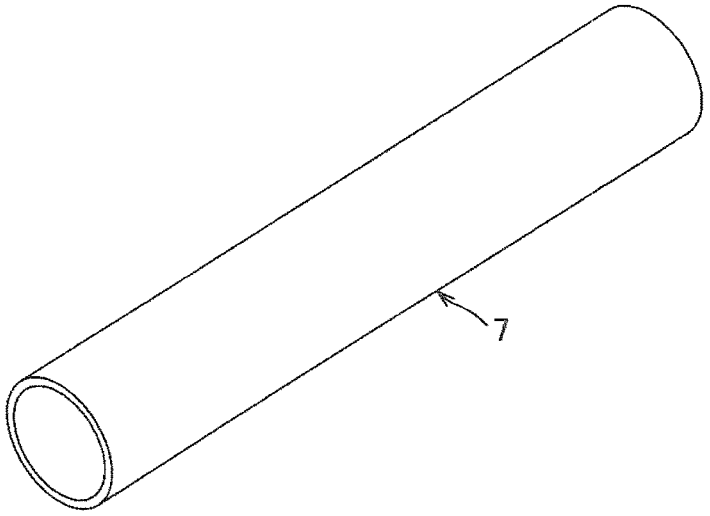
Figure 4C:
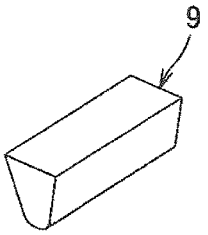

First, as shown in FIGS. 4A to 4C, the electric cable connection terminal 4 of the invention is divided into the terminal main body part 11 configuring the electric cable connection terminal 4, the thermal shrinkage tube 7 having permeability and the thermoplastic adhesive 9 colored such as red, respectively. Subsequently, as shown in FIG. 5, the aluminum electric cable 2, which has the core wire 2*a* consisting of aluminum or aluminum alloy and exposed at the stripped terminal of the cover part 2*b*, is inserted into the thermal shrinkage tube 7, the core wire 2*a* is arranged at the pair of first core wire swaging pieces 18 of the terminal main body part 11, the first core wire swaging pieces 18 are swaged to connect the core wire 2*a* by a compression tool and the like and the first cover swaging pieces 17 are swaged to connect the cover part 2*b* by the compression tool and the like.

Figure 5:
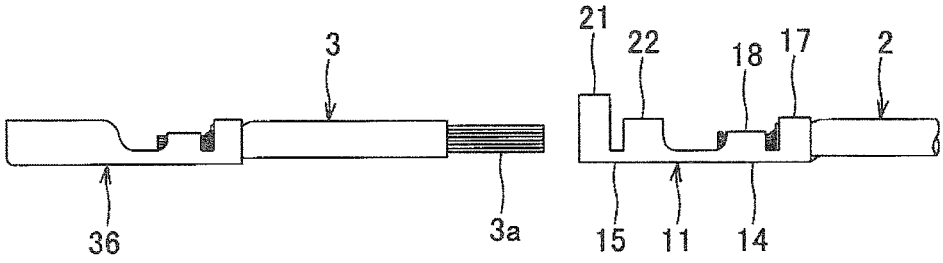
FIG. 5 illustrates a state where the other electric cable is connected to the electric cable connection terminal.

Then, as shown in FIG. 5, the copper electric cable 3 having the terminal fitting 36 at the one terminal and the core wire 3*a* consisting of copper or copper alloy and exposed at the stripped other terminal of the cover part 3*b* is connected to the second electric cable connection part 15 of the terminal main body part 11. At this time, as shown in FIG. 6, the second core wire swaging pieces 22 of the second electric cable connection part 15 are swaged to connect the core wire 3*a* by the compression tool and the like and the second cover swaging pieces 21 are swaged to connect the cover part 3*b* by the compression tool and the like.

Figure 6:
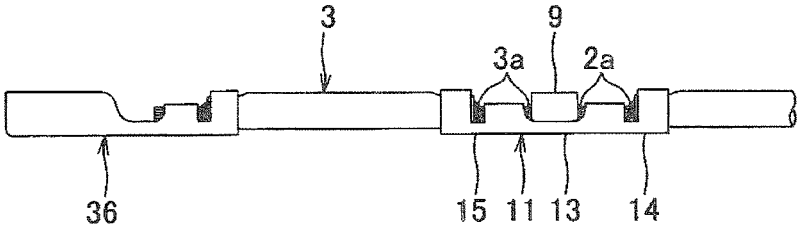
FIG. 6 illustrates a state where a sealing member is accommodated in an accommodation part of the electric cable connection terminal.
Figure 7:
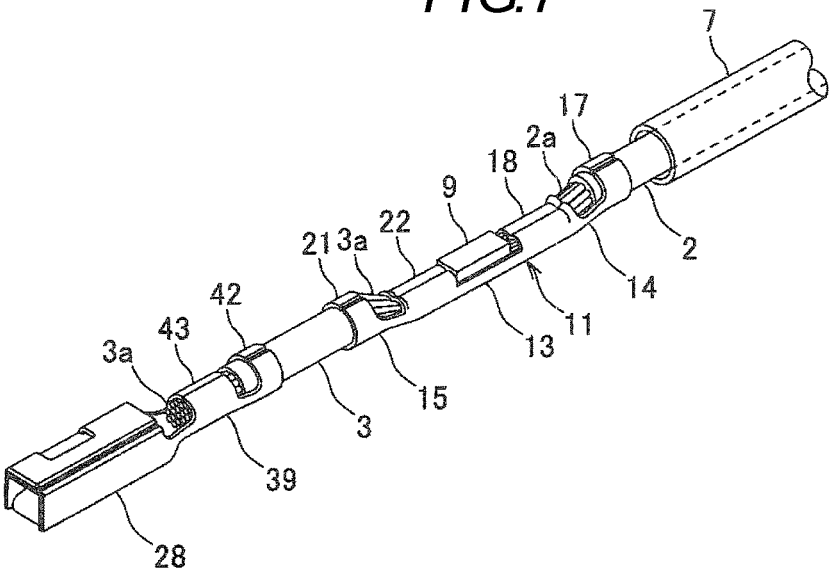
FIG. 7 illustrates a state where the thermal shrinkage tube is attached to the electric cable connection terminal.

Then, as shown in FIGS. 6 and 7, the thermoplastic adhesive 9 is accommodated in the accommodation part 13 of the terminal main body part 11, the terminal main body part 11 is covered with the thermal shrinkage tube 7 having the aluminum electric cable 2 inserted therethrough, and the cover part 2*b* of the aluminum electric cable 2, which is at the terminal facing the terminal main body part 11, is covered with the thermal shrinkage tube 7 at one end thereof and the cover part 3*b* of the copper electric cable 3, which is at the terminal facing the terminal main body part 11, is covered with the thermal shrinkage tube 7 at the other end thereof. At this time, the cover part 2*b* of the aluminum electric cable 2, which is at the terminal facing the terminal main body part 11, the cover part 3*b* of the copper electric cable 3, which is at the terminal facing the terminal main body part 11, and the terminal main body part 11 are covered with the thermal shrinkage tube 7.

Subsequently, as shown in FIG. 1, the thermal shrinkage tube 7 is heated and shrunken by a heating means such as dryer, heat gun and the like, the thermal shrinkage tube 7 is closely contacted to the cover parts 2*b*, 3*b* and the terminal main body part 11, which are then cooled by natural cooling or forcible cooling. At this time, when the shrinkage temperature at which the thermal shrinkage tube 7 is shrunken is 130° C., the shrinkage time is 20 seconds, a dropping point at which the thermoplastic adhesive 9 is melted is 130° C. and the melting time is 30 seconds, as the thermal shrinkage tube 7 is shrunken, the melted thermoplastic adhesive 9 is extruded outward and is thus enabled to flow into the first core wire swaging pieces 18 of the first electric cable connection part 14 and the second core wire swaging pieces 22 of the second electric cable connection part 15. When a spread distance of the flowing thermoplastic adhesive 9 is larger than a predetermined spread distance h, the melting and spread of the thermoplastic adhesive 9 are sufficient and the shrinkage of the thermal shrinkage tube 7 is also sufficient, so that it is determined that the wire harness 1 of good quality is manufactured.

In the wire harness 1 manufactured as described above, the core wire 2*a* at the terminal of the aluminum electric cable 2 and the core wire 3*a* at the terminal of the copper electric cable 3 are sealed by the thermoplastic adhesive 9 solidified after the melting, as shown in FIG. 3. Also, the core wire 2*a* at the terminal of the aluminum electric cable 2 and the core wire 3*a* at the terminal of the copper electric cable 3 are arranged at an interval via the thermoplastic adhesive 9. Therefore, the water is securely prevented from being introduced to the core wire 2*a* of the aluminum electric cable 2 and the core wire 3*a* of the copper electric cable 3 and the core wires 2*a*, 3*a* are securely prevented from being contacted to each other and thus corroded.

According to this illustrative embodiment, the electric cable connection terminal 4 includes the first electric cable connection part 14 that is provided at one end side thereof and to which the aluminum electric cable 2 is connected, the second electric cable connection part 15 that is provided at the other end side and to which the copper electric cable 3 is connected, the thermoplastic adhesive 9 serving as the waterproof member that is melted to seal the leading end portion of the core wire 2*a* of the aluminum electric cable 2 and the leading end portion of the core wire 3*a* of the copper electric cable 3 when the thermoplastic adhesive is heated and is solidified to waterproof the leading end portion of the core wire 2*a* of the aluminum electric cable 2 and the leading end portion of the core wire 3*a* of the copper electric cable 3 when the thermoplastic adhesive is cooled, the accommodation part 13 that is provided between the first electric cable connection part 14 and the second electric cable connection part 15 and accommodates therein the thermoplastic adhesive 9, and the thermal shrinkage tube 7 serving as the thermal shrinkage member that covers the first electric cable connection part 14, the second electric cable connection part 15 and the accommodation part 13 and is shrunken and is thus closely contacted to the first electric cable connection part 14, the second electric cable connection part 15 and the accommodation part 13 when the thermal shrinkage tube is heated. When the aluminum electric cable 2 is connected to the first electric cable connection part 14 and the copper electric cable 3 is connected to the second electric cable connection part 15, the core wire 2*a* of the aluminum electric cable 2 and the core wire 3*a* of the copper electric cable 3 are arranged at an interval.

Therefore, even when the water is introduced from the aluminum electric cable 2 and the copper electric cable 3 by the capillary phenomenon, the electric cable connection terminal 4 can prevent the water from being introduced to the leading end portion of the core wire 2*a* of the aluminum electric cable 2 and the leading end portion of the core wire 3*a* of the copper electric cable 3. As a result, it is possible to prevent the corrosions of the leading end portion of the core wire 2*a* of the aluminum electric cable 2 and the leading end portion of the core wire 3*a* of the copper electric cable 3.

Also, the leading end portion of the core wire 2*a* made of aluminum or aluminum alloy and the leading end portion of the core wire 3*a* made of copper or copper alloy are arranged at an interval. Thus, the electric cable connection terminal 4 can prevent the contact corrosion of the different metals, which is caused as both the core wires 2*a*, 3*a* are contacted to each other, and to thus prevent the respective contact resistances of both the core wires 2*a*, 3*a* from being increased.

Also, according to the electric cable connection terminal 4, the universal terminal fitting 36 can be used for connection with an electronic device and the like. Hence, it is possible to prevent the cost from being increased due to the development, the evaluation test and the like of a new terminal fitting.

Also, according to the electric cable connection terminal 4, the respective electric cables 2, 3 are connected by the compression connection having the sufficient performance and reliability. Thus, the reliability of the electric cable connection terminal 4 is sufficiently secured.

Also, according to the electric cable connection terminal 4, the thermal shrinkage tube 7 has the permeability and the thermoplastic adhesive 9 is colored. Therefore, when the thermal shrinkage tube 7 is heated and thus closely contacted to the first electric cable connection part 14, the second electric cable connection part 15 and the accommodation part 13, it is possible to check a state where the thermoplastic adhesive 9 accommodated in the accommodation part 13 is being melted and spread to the leading end portion of the core wire 2*a* of the aluminum electric cable 2 and the leading end portion of the core wire 3*a* of the copper electric cable 3 with naked eyes. Hence, it is possible to securely seal and waterproof the leading end portions of both the core wires 2*a*, 3*b* with the thermoplastic adhesive 9 by checking the state where the thermoplastic adhesive 9 is sufficiently melted and spread to both the leading end portions with naked eyes.

Also, according to the electric cable connection terminal 4, since the thermoplastic adhesive 9 is used as the waterproof member, the handling and the operation thereof are easy and the cost thereof is also cheap. Also, since the thermoplastic adhesive 9 is rapidly cured, the processing time is shortened and thus the productivity becomes favorable.

The wire harness is connected via the electric cable connection terminal 4 of the invention. Hence, it is possible to prevent the corrosions of the leading end portion of the core wire 2*a* of the aluminum electric cable 2 and the leading end portion of the core wire 3*a* of the copper electric cable 3, to prevent the contact corrosion of the different metals, which is caused as both the core wires 2*a*, 3*a* are contacted to each other, and to thus prevent the respective contact resistances of the core wires 2*a*, 3*a* from being increased and to securely seal and to waterproof the leading end portions of both the core wires 2*a*, 3*b* with the thermoplastic adhesive 9. Also, the wire harness 1 is cheap and the productivity thereof becomes favorable.

In the illustrative embodiment, the configuration of waterproofing the aluminum electric cable 2 and the copper electric cable 3 has been described. However, a configuration is also possible in which the copper electric cables 3 are connected to both ends of the electric cable connection terminal 4 and the leading end portions of the core wires 3*a* of the copper electric cables 3 are waterproofed.

In the meantime, the illustrative embodiment just exemplifies the representative form of the invention and the invention is not limited thereto. That is, the illustrative embodiment can be variously modified without departing from the scope of the invention.

What is claimed is:

1. An electric cable connection terminal configured to connect one electric cable and the other electric cable, the electric cable connection terminal comprising:

a first electric cable connection part provided at one end side of the electric cable connection terminal and configured to connect the one electric cable thereto;

a second electric cable connection part provided at the other end side of the electric cable connection terminal and configured to connect the other electric cable thereto;

a waterproof member configured to be melted to seal a leading end portion of a core wire of the one electric cable and a leading end portion of a core wire of the other electric cable when being heated and configured to be solidified to waterproof the leading end portion of the core wire of the one electric cable and the leading end portion of the core wire of the other electric cable when being cooled, the waterproof member provided between the leading end portion of the core wire of the one electric cable and the leading end portion of the core wire of the other electric cable;

an accommodation part provided between the first electric cable connection part and the second electric cable connection part and configured to accommodate the waterproof member therein; and a thermal shrinkage member provided to cover the first electric cable connection part, the second electric cable connection part and the accommodation part and configured to be shrunken when being heated to closely contact the first electric cable connection part, the second electric cable connection part and the accommodation part, wherein when the one electric cable is connected to the first electric cable connection part and the other electric cable is connected to the second electric cable connection part, the core wire of the one electric cable and the core wire of the other electric cable are arranged at an interval so as to have a space therebetween in which the waterproof member is disposed, wherein the waterproof member is non-conductive, wherein the accommodation part includes an opening in a periphery thereof for receiving the waterproof member, and wherein the opening extends from a location where the leading end portion of the core wire of the one electric cable is arranged to a location where the leading end portion of the core wire of the other electric cable is arranged.

2. The electric cable connection terminal according to claim 1, wherein the core wire of the one electric cable is made of aluminum or aluminum alloy, and wherein the core wire of the other electric cable is made of copper or copper alloy.

3. The electric cable connection terminal according to claim 1, wherein the thermal shrinkage member has permeability, and wherein the waterproof member is colored.

4. The electric cable connection terminal according to claim 1, wherein the waterproof member is made of a thermoplastic adhesive or grease.

5. A wire harness having one electric cable and the other electric cable which are connected via the electric cable connection terminal according to claim 1.

6. The electric cable connection terminal according to claim 1, wherein the first electric cable connection part having a pair of first cover swaging pieces to cover a cover part of the one electric cable, and wherein the second electric cable connection part having a pair of second cover swaging pieces to cover a cover part of the other electric cable.

7. The electric cable connection terminal according to claim 1, wherein the first electric cable connection part having a pair of first core wire swaging pieces to cover the core of the one electric cable, and wherein the second electric cable connection part having a pair of second core wire swaging pieces to cover the core of the other electric cable.

8. The electric cable connection terminal according to claim 1, wherein the shape of the accommodation space corresponds to the shape of the waterproof member.

* * * * *